US009299335B2

(12) United States Patent
Lan et al.

(10) Patent No.: US 9,299,335 B2
(45) Date of Patent: Mar. 29, 2016

(54) HANDHELD ELECTRONIC DEVICE AND CORRESPONDING NOISE-CANCELING HEADPHONES

(71) Applicant: MERRY ELECTRONICS (SHENZHEN) CO., LTD., ShenZhen (CN)

(72) Inventors: Ya-Ke Lan, New Taipei (TW); Hung-Yuan Li, New Taipei (TW); Huai-Yuan Chang, New Taipei (TW)

(73) Assignee: MERRY ELECTRONICS (SHENZHEN) CO., LTD., Shenzhen (CN)

( * ) Notice: Subject to any disclaimer, the term of this patent is extended or adjusted under 35 U.S.C. 154(b) by 143 days.

(21) Appl. No.: 14/256,206

(22) Filed: Apr. 18, 2014

(65) Prior Publication Data

US 2014/0376734 A1 Dec. 25, 2014

(30) Foreign Application Priority Data

Jun. 25, 2013 (TW) ..... 102122562 A

(51) Int. Cl.
*H04R 1/10* (2006.01)
*G10K 11/178* (2006.01)

(52) U.S. Cl.
CPC ..... *G10K 11/1788* (2013.01); *H04R 1/1025* (2013.01); *H04R 1/1083* (2013.01); *G10K 2210/1081* (2013.01); *H04R 2460/01* (2013.01)

(58) Field of Classification Search
CPC ..... H04R 5/033; H04R 5/04; H04R 1/041; H04R 1/1016; H04R 2420/07
See application file for complete search history.

(56) References Cited

U.S. PATENT DOCUMENTS

2006/0029234 A1* 2/2006 Sargaison ..... H04M 1/6058 381/74
2006/0034465 A1* 2/2006 Jeong ..... H04N 5/2251 381/74
2008/0112572 A1* 5/2008 Wong ..... H04R 1/1041 381/74
2008/0130911 A1* 6/2008 Tsen ..... H04R 5/04 381/74
2009/0136058 A1* 5/2009 Choi ..... H04R 5/04 381/74
2010/0069114 A1* 3/2010 Lee ..... H04M 1/585 455/556.1
2011/0216912 A1* 9/2011 Seo ..... H04R 1/10 381/74
2012/0128185 A1* 5/2012 Wu ..... H04R 3/00 381/309
2012/0237051 A1* 9/2012 Lee ..... H01R 13/66 381/74
2012/0317314 A1* 12/2012 Choi ..... H04M 1/72527 710/8
2013/0089216 A1* 4/2013 Han ..... H04R 29/001 381/74
2013/0129109 A1* 5/2013 Jung ..... H04R 1/1041 381/74
2013/0142350 A1* 6/2013 Larsen ..... H04R 1/1041 381/74

* cited by examiner

*Primary Examiner* — Simon Sing
(74) *Attorney, Agent, or Firm* — WPAT, PC; Justin King

(57) ABSTRACT

A handheld electronic device including a connection interface, a voltage supply unit and a baseband circuit is provided. When headphones are connected to the handheld electronic device, the baseband circuit can determine the type of the headphones by controlling the operation of the voltage supply unit. Furthermore, when the headphones are noise-canceling headphones, the baseband circuit can control the operation of the voltage supply unit to provide operation power to the noise-canceling headphones. In addition, corresponding noise-canceling headphones including a connection interface, at least one switch circuit, a switch control unit, a communication microphone, two speakers, a noise-canceling circuit and two noise-canceling microphones is also provided.

9 Claims, 6 Drawing Sheets

HANDHELD ELECTRONIC DEVICE AND CORRESPONDING NOISE-CANCELING HEADPHONES

FIELD OF THE INVENTION

The present invention relates to a handheld electronic device and a corresponding noise-canceling headphone, and more particularly to a handheld electronic device capable of supplying an operation power to a being-connected noise-canceling headphone and a noise-canceling headphone capable of receiving an operation power from a being-connected handheld electronic device.

BACKGROUND OF THE INVENTION

Because noise-canceling headphones can eliminate external ambient noise, consequentially users can enjoy music without volume up the music or have a nice sleep on airplanes, trains or buses. Therefore, noise-canceling headphones are becoming more and more popular.

However, the conventional noise-canceling headphone is powered by batteries for a noise-canceling circuit therein. Thus, the conventional noise-canceling headphone may have relatively-large size and increasing weight, which may cause an inconvenience for users.

SUMMARY OF THE INVENTION

The present invention provides a handheld electronic device, which includes a connection interface, a first impedance unit, a second impedance unit, a voltage supply unit and a baseband circuit. The connection interface includes a first pin, a second pin and a third pin. The first pin is configured to transmit a first speaker signal and the second pin is configured to transmit a second speaker signal. The first impedance unit is electrically connected between the second pin and a power supply voltage. The second impedance unit is electrically connected between the second pin and a reference voltage. The voltage supply unit is electrically connected to the third pin. The baseband circuit is electrically connected to the second pin, the third pin and the voltage supply unit. The baseband circuit is configured to determine whether there is a headphone being electrically connected to the connection interface according to a voltage change at the second pin. When there is a headphone being electrically connected to the connection interface, the baseband circuit is further configured to control the voltage supply unit to provide a first voltage to the third pin and then determine a type of the headphone according to a voltage at the third pin. When the headphone is determined as a noise-canceling headphone and the handheld electronic device decides to activate a noise-canceling function of the noise-canceling headphone, correspondingly the baseband circuit is configured to control the voltage supply unit to provide a second voltage to the third pin, wherein the second voltage is functioned as an operation power of a noise-canceling circuit, for providing the noise-canceling function, of the noise-canceling headphone.

The present invention further provides a noise-canceling headphone corresponding to the aforementioned handheld electronic device. The noise-canceling headphone includes a connection interface, a first switch circuit, a switch control unit, a communication microphone, a first speaker, a second speaker, a first noise-canceling microphone, a second noise-canceling microphone and a noise-canceling circuit. The connection interface is for being electrically connected to a handheld electronic device and includes a first pin, a second pin and a third pin. The first pin is configured to receive a first speaker signal and the second pin is configured to receive a second speaker signal. The first switch circuit includes a first terminal, a second terminal, a third terminal and a first control terminal. The first terminal is electrically connected to the third pin. The first switch circuit is configured to, according to a voltage supplied to the first control terminal, selectively electrically connect the first terminal to the second terminal or electrically connect the first terminal to the third terminal. The switch control unit is electrically connected to the third pin and the first control terminal. The switch control unit is configured to control, according to a voltage at the third pin, the first switch circuit to selectively electrically connect the first terminal to the second terminal or electrically connect the first terminal to the third terminal. The communication microphone is electrically connected to the second terminal. The first speaker is electrically connected to the first pin. The second speaker is electrically connected to the second pin. The noise-canceling circuit is electrically connected to the third terminal, the first speaker, the second speaker, the first noise-canceling microphone and the second noise-canceling microphone.

The present invention still further provides a noise-canceling headphone corresponding to the aforementioned handheld electronic device. The noise-canceling headphone includes a connection interface, a switch circuit, a switch control unit, a communication microphone, a first speaker, a second speaker, a first noise-canceling microphone, a second noise-canceling microphone and a noise-canceling circuit. The connection interface is for being electrically connected to a handheld electronic device and includes a first pin, a second pin and a third pin. The first pin is configured to receive a first speaker signal and the second pin is configured to receive a second speaker signal. The switch circuit includes a first terminal, a second terminal and a control terminal. The first terminal is electrically connected to the third pin. The control terminal is configured to receive a comparison result. The switch circuit is configured to determine whether to electrically connect the first terminal to the second terminal or not according to the comparison result. The switch control unit is electrically connected to the third pin and the control terminal. The switch control unit is configured to control, according to a voltage at the third pin, the first switch circuit to selectively electrically connect the first terminal to the second terminal. The communication microphone is electrically connected to the third pin. The first speaker is electrically connected to the first pin. The second speaker is electrically connected to the second pin. The noise-canceling circuit is electrically connected to the second terminal, the first speaker, the second speaker, the first noise-canceling microphone and the second noise-canceling microphone.

In summary, the handheld electronic device of the present invention includes a connection interface, a voltage supply unit and a baseband circuit. When headphones are connected to the handheld electronic device, the baseband circuit can determine the type of the headphones by controlling the operation of the voltage supply unit. Furthermore, when the headphones are noise-canceling headphones, the baseband circuit can control the operation of the voltage supply unit to provide operation power to the noise-canceling headphones. In addition, a corresponding noise-canceling headphone of the present invention includes a connection interface, at least one switch circuit, a switch control unit, a communication microphone, two speakers, a noise-canceling circuit and two noise-canceling microphones; wherein the noise-canceling headphone of the present invention can have normal function without equipping any battery.

For making the above and other purposes, features and benefits become more readily apparent to those ordinarily skilled in the art, the preferred embodiments and the detailed descriptions with accompanying drawings will be put forward in the following descriptions.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
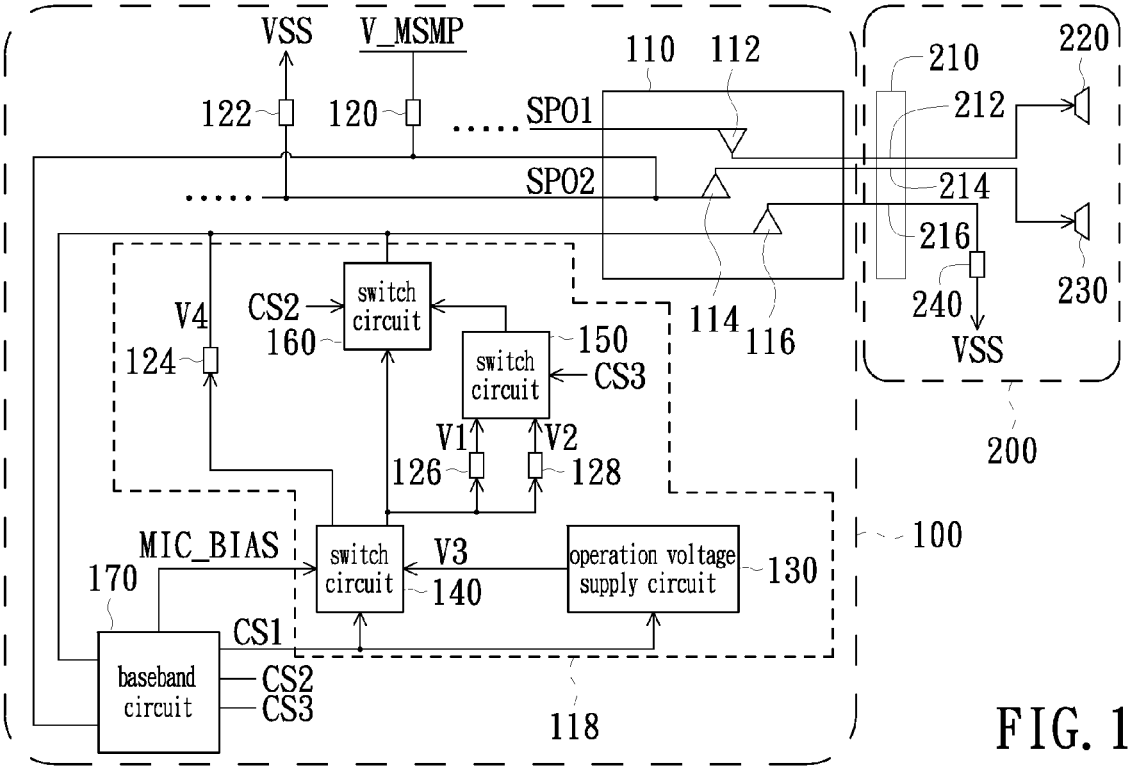
FIG. 1 is a schematic circuit diagram of a handheld electronic device and a corresponding regular headphone equipped with a communication microphone in accordance with an embodiment of the present invention.

FIG. 1 is a schematic circuit diagram of a handheld electronic device 100 and a corresponding regular headphone 200 equipped with a communication microphone in accordance with an embodiment of the present invention. As shown, the handheld electronic device 100 in this embodiment includes a connection interface 110, impedance units 120, 122, a voltage supply unit 118 and a baseband circuit 170. The connection interface 110 includes pins 112, 114 and 116. Specifically, the pin 112 is configured to transmit a speaker signal SPO1; and the pin 114 is configured to transmit a speaker signal SPO2. The impedance unit 120 is electrically connected between the pin 114 and a power supply voltage V_MSMP; and the impedance unit 122 is electrically connected between the pin 114 and a reference voltage VSS. The voltage supply unit 118 is electrically connected to the pin 116. The baseband circuit 170 is electrically connected to the pins 114, 116 and the voltage supply unit 118.

In this embodiment as shown in FIG. 1, the baseband circuit 170 is configured to determine whether there is a headphone being connected to the connection interface 110 according to a voltage change at the pin 114. If yes, the baseband circuit 170 is further configured to control the voltage supply unit 118 to provide an operation voltage V1 to the pin 116 and then determine the type of the being-connected headphone according to the voltage at the pin 116. In one case, when the being-connected headphone is determined as, for example, a noise-canceling headphone and the handheld electronic device 100 decides to activate the noise-canceling function of the noise-canceling headphone, correspondingly the baseband circuit 170 is configured to control the voltage supply unit 118 to provide an operation voltage V3 to the pin 116; wherein the operation voltage V3 herein is functioned as an operation power of a noise-canceling circuit in the noise-canceling headphone. In another case, when the being-connected headphone is determined as, for example, a noise-canceling headphone but the handheld electronic device 100 decides not to activate the noise-canceling function of the noise-canceling headphone, correspondingly the baseband circuit 170 is configured to control the voltage supply unit 118 to provide an operation voltage V2 to the pin 116 first, and then stop providing the operation voltage V2 but provide an operation voltage V4 to the pin 116; wherein the operation voltage V4 herein is functioned as an operation power of the communication microphone of the noise-canceling headphone. The process of sequentially providing the aforementioned operation voltages V2, V4 will be described in detailed later. In still another case, when the being-connected headphone is determined as, for example, a regular headphone (equipped with a communication microphone but without noise-canceling function), correspondingly the baseband circuit 170 is configured to provide a microphone bias voltage MIC_BIAS and control the voltage supply unit 118 to convert the microphone bias voltage MIC_BIAS into the operation voltage V4 and provide the operation voltage V4 to the pin 116; wherein the operation voltage V4 herein is functioned as an operation power of the communication microphone of the regular headphone. The implementation of the voltage supply unit 118 and the operation of the baseband circuit 170 will be described in detailed as follow.

In this embodiment as shown in FIG. 1, the voltage supply unit 118 includes an operation voltage supply circuit 130, switch circuit 140, 150 and 160, and impedance units 124, 126 and 128. The operation voltage supply circuit 130 is configured to receive a control signal CS1 and determine whether to output the operation voltage V3 or not according to the received control signal CS1. The switch circuit 140 includes a first input terminal, a second input terminal, a first output terminal, a second output terminal and a control terminal. The first input terminal, the second input terminal and the control terminal of the switch circuit 140 are configured to receive the microphone bias voltage MIC_BIAS, the operation voltage V3 and the control signal CS1, respectively. The switch circuit 140 is configured to, according to the control signal CS1, either output the microphone bias voltage MIC_BIAS through the first output terminal thereof or output the operation voltage V3 through the second output terminal thereof. The impedance unit 124, electrically connected between the first output terminal of the switch circuit 140 and the pin 116, is configured to generate the operation voltage V4. The first terminal of the impedance unit 126 is electrically connected to the second output terminal of the switch circuit 140. The first terminal of the impedance unit 128 is electrically connected to the second output terminal of the switch circuit 140.

The switch circuit 150 includes a first input terminal, a second input terminal, an output terminal and a control terminal. The first input terminal and the second input terminal of the switch circuit 150 are electrically connected to a second terminal of the impedance unit 126 and a second terminal of the impedance unit 128, respectively. The control terminal of the switch circuit 150 is configured to receive a control signal CS3. The switch circuit 150 is configured to, according to the control signal CS3, either output the voltage supplied to the first input terminal thereof or output the voltage supplied to the second input terminal thereof. The switch circuit 160 includes a first input terminal, a second input terminal, an output terminal and a control terminal. The first input terminal and the second input terminal of the switch circuit 160 are electrically connected to the second output terminal of the switch circuit 140 and the output terminal of the switch circuit 150, respectively. The output terminal of the switch circuit 160 is electrically connected to the pin 116. The control terminal of the switch circuit 160 is configured to receive a control signal CS2. The switch circuit 160 is configured to either output the voltage supplied to the first input terminal thereof or output the voltage supplied to the second input terminal thereof according to the received control signal CS2.

In this embodiment as shown in FIG. 1, the baseband circuit 170 is further configured to provide the microphone bias voltage MIC_BIAS and the control signals CS1, CS2 and CS3. In one embodiment, each one of the impedance units 120~128 may be implemented with a resistor; however the present invention is not limited thereto. In addition, it is to be noted that the impedance units 120~128 are configured to have different impendence values.

As shown in FIG. 1, the headphone 200 in this embodiment includes a connection interface 210, speakers 220, 230, and a communication microphone (not shown but is represented by an impedance 240). The connection interface 210 is configured to be electrically connected to the connection interface 110 of the handheld electronic device 100. The connection interface 210 includes pins 212, 214 and 216. Specifically, the pin 212 is configured to receive the speaker signal SPO1; and the pin 214 is configured to receive the speaker signal SPO2.

The baseband circuit 170 can determine whether there is a headphone being connected to the handheld electronic device 100 or not through detecting a voltage change at the pin 114. For example, when a headphone (for example, the headphone 200) is detected being connected to the handheld electronic device 100, the baseband circuit 170 first controls, through the control signal CS1, the operation voltage supply circuit 130 to output the operation voltage V3 and controls, through the control signal CS1, the switch circuit 140 to output the operation voltage V3 through the second output terminal thereof. In addition, the baseband circuit 170 further controls, through the control signal CS3, the switch circuit 150 to output the voltage supplied to the first input terminal thereof and controls, through the control signal CS2, the switch circuit 160 to output the voltage supplied to the second input terminal thereof. As a result, the operation voltage V1 (derived from the operation voltage V3 of the operation voltage supply circuit 130) supplied to the first input terminal of the switch circuit 150 can be transmitted to the communication microphone of the headphone 200 sequentially through the switch circuit 150, the switch circuit 160, the pin 116 and the pin 216. In addition, because the communication microphone has the specific impedance 240, the baseband circuit 170 can determine that the being-connected headphone 200 is a regular headphone equipped with a communication microphone according to the voltage at the pin 116.

Then, the baseband circuit 170 outputs the microphone bias voltage MIC_BIAS and also controls, through the control signal CS1, the switch circuit 140 to output the microphone bias voltage MIC_BIAS through the first output terminal thereof. As a result, the operation voltage V4 (derived from the microphone bias voltage MIC_BIAS of the baseband circuit 170) is successfully transmitted to the communication microphone of the headphone 200 sequentially through the pin 116 and the pin 216 and thereby the communication microphone is enabled to start to work.

Figure 2:
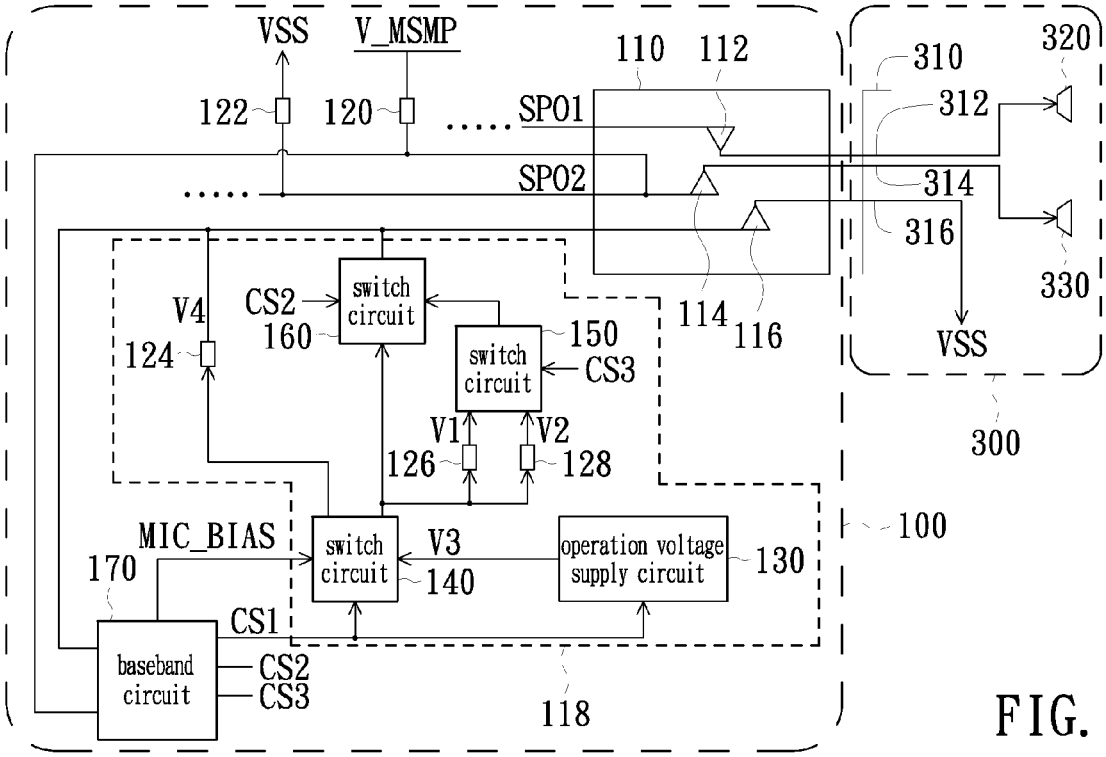
FIG. 2 is a schematic circuit diagram of a handheld electronic device and a corresponding regular headphone equipped with no communication microphone in accordance with an embodiment of the present invention.

FIG. 2 is a schematic circuit diagram of the handheld electronic device 100 and a corresponding regular headphone 300 equipped with no communication microphone in accordance with an embodiment of the present invention. The function and the circuit stricture of the handheld electronic device 100 have been described above, and no redundant detail is to be given herein. As shown, the communication headphone 300 in this embodiment includes a connection interface 310 and speakers 320, 330. The connection interface 310 is configured to be electrically connected to the connection interface 110 of the handheld electronic device 100. The connection interface 310 includes pins 312, 314 and 316. Specifically, the pin 312 is configured to receive the speaker signal SPO1; and the pin 314 is configured to receive the speaker signal SPO2.

As described above, the baseband circuit 170 can determine whether there is a headphone being connected to the handheld electronic device 100 or not through detecting a voltage change at the pin 114. For example, when a headphone (for example, the headphone 300) is detected being connected to the handheld electronic device 100, the baseband circuit 170 first controls, through the control signal CS1, the operation voltage supply circuit 130 to output the operation voltage V3 and also controls, through the control signal CS1, the switch circuit 140 to output the operation voltage V3 through the second output terminal thereof. In addition, the baseband circuit 170 further controls, through the control signal CS3, the switch circuit 150 to output the voltage supplied to the first input terminal thereof and also control, through the control signal CS2, the switch circuit 160 to output the voltage supplied to the second input terminal thereof. As a result, the operation voltage V1 (derived from the operation voltage V3 of the operation voltage supply circuit 130) supplied to the first input terminal of the switch circuit 150 can be transmitted to the headphone 300 sequentially through the switch circuit 150, the switch circuit 160, the pin 116 and the pin 316. In addition, because one terminal of the pin 316 is directly electrically connected to the reference voltage VSS, the baseband circuit 170 can determine that the being-connected headphone 300 is a regular headphone equipped with no communication microphone according to the voltage at the pin 116.

Because the headphone 300 is determined as a regular headphone equipped with no communication microphone, correspondingly the baseband circuit 170 is configured to not to output the microphone bias voltage MIC_BIAS. In addition, the baseband circuit 170 may be further configured to control, through the control signal CS1, the switch circuit 140 not to output the operation voltage V3.

Figure 3:
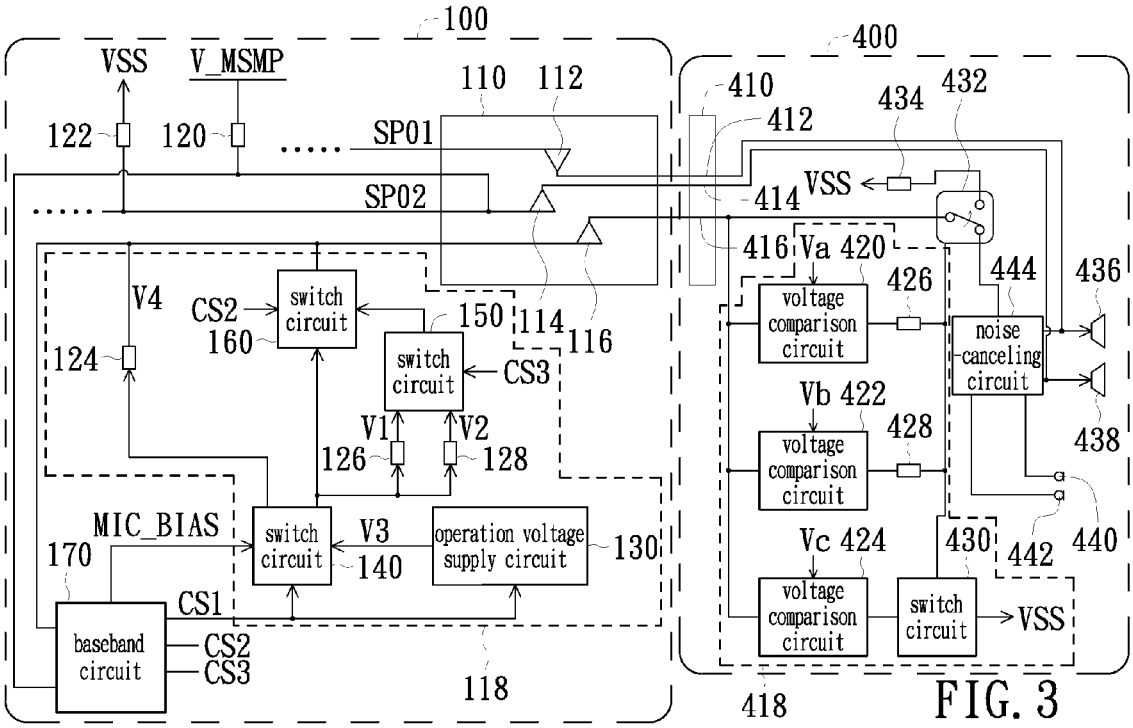
FIG. 3 is a schematic circuit diagram of a handheld electronic device and a corresponding noise-canceling headphone in accordance with an embodiment of the present invention.

FIG. 3 is a schematic circuit diagram of the handheld electronic device 100 and a corresponding noise-canceling headphone 400 in accordance with an embodiment of the present invention. The function and the circuit stricture of the handheld electronic device 100 have been described above, and no redundant detail is to be given herein. As shown, the noise-canceling headphone 400 in this embodiment includes a connection interface 410, a switch circuit 432, a switch control unit 418, a communication microphone (not shown but is represented by an impedance 434), speakers 436, 438, noise-canceling microphones 440, 442, and a noise-canceling circuit 444. The connection interface 410 is configured to be electrically connected to the connection interface 110 of the handheld electronic device 100. The connection interface 410 includes pins 412, 414 and 416. Specifically, the pin 412 is configured to receive the speaker signal SPO1; and the pin 414 is configured to receive the speaker signal SPO2. The switch circuit 432 includes a first terminal, a second terminal, a third terminal and a control terminal; wherein the first terminal is electrically connected to the pin 416. The switch circuit 432 is configured to selectively electrically connect its first terminal to its second terminal or electrically connect its first terminal to its third terminal according to the voltage supplied to its control terminal.

In this embodiment as shown in FIG. 3, the switch control unit 418 is electrically connected to the pin 416 and the control terminal of the switch circuit 432. The switch control unit 418 is configured to control, according to the voltage at the pin 416, the switch circuit 432 to selectively electrically connect its first terminal to its second terminal or electrically connect its first terminal to its third terminal. The switch control unit 418 includes voltage comparison circuits 420, 422 and 424, impedance units 426, 428, and a switch circuit 430. The voltage comparison circuit 420 includes a first input terminal, a second input terminal and an output terminal. The first input terminal of the voltage comparison circuit 420 is electrically connected to the pin 416; and the second input terminal of the voltage comparison circuit 420 is configured to receive a voltage Va. The voltage comparison circuit 420 is configured to compare the voltage at the pin 416 with the voltage Va and accordingly output a first comparison result through the output terminal thereof. The voltage comparison circuit 422 includes a first input terminal, a second input terminal and an output terminal. The first input terminal of the voltage comparison circuit 422 is electrically connected to the pin 416; and the second input terminal of the voltage comparison circuit 422 is configured to receive a voltage Vb. The voltage comparison circuit 422 is configured to compare the voltage at the pin 416 with the voltage Vb and accordingly output a second comparison result through the output terminal thereof. The voltage comparison circuit 424 includes a first input terminal, a second input terminal and an output terminal. The first input terminal of the voltage comparison circuit 424 is electrically connected to the pin 416; and the second input terminal of the voltage comparison circuit 424 is configured to receive a voltage Vc. The voltage comparison circuit 424 is configured to compare the voltage at the pin 416 with the voltage Vc and accordingly output a third comparison result through the output terminal thereof.

The first terminal of the impedance unit 426 is electrically connected to the output terminal of the voltage comparison circuit 420. The first terminal of the impedance unit 428 is electrically connected to the output terminal of the voltage comparison circuit 422. The switch circuit 430 includes a first terminal, a second terminal and a control terminal. The first terminal of the switch circuit 430 is electrically connected to the second terminals of the impedance units 426, 428; the second terminal of the switch circuit 430 is electrically connected to the reference voltage VSS; and the control terminal of the switch circuit 430 is configured to receive the third comparison result. The switch circuit 430 is configured to determine whether to electrically connect its first terminal to its second terminal or not according to the received third comparison result.

The communication microphone (not shown but is represented by an impedance 434) of the noise-canceling headphone 400 is electrically connected to the second terminal of the switch circuit 432. The speaker 436 is electrically connected to the pin 412; and the speaker 438 is electrically connected to the pin 414. The noise-canceling circuit 444 is electrically connected to the third terminal of the switch circuit 432, the speakers 436, 438, and the noise-canceling microphones 440, 442.

In one embodiment, each one of the voltage comparison circuits 420, 422 and 424 may be implemented with a comparator, and accordingly the first and second input terminals of each voltage comparison circuit are referred to the positive and negative terminals of the respective comparator, respectively; but the present invention is not limited thereto. In one embodiment, each one of the impedance units 426, 428 may be implemented with a resistor; however the present invention is not limited thereto. In this exemplary embodiment, it is to be noted that the aforementioned mentioned voltages are configured to have the following relationships:

$$V3>Vc>V2>Vb>V1>Va \text{ and } Vc>V4>Vb$$

Furthermore, in this embodiment, the switch circuit 432 electrically connects its first terminal to its second terminal when the voltage supplied to its control terminal has a logic-high level; alternatively, the switch circuit 432 electrically connects its first terminal to its third terminal when the voltage supplied to its control terminal has a logic-low level. In one embodiment, the switch circuit 432 is initially configured to have the first terminal thereof electrically connected to the third terminal thereof. The switch circuit 430 electrically connects its first terminal to its second terminal and thereby has a turned-on state when the voltage supplied to its control terminal has a logic-high level; alternatively, the switch circuit 430 disconnects its first terminal from its second terminal and thereby has a turned-off state when the voltage supplied to its control terminal has a logic-low level.

As described above, the baseband circuit 170 can determine whether there is a headphone being connected to the handheld electronic device 100 or not through detecting a voltage change at the pin 114. For example, when a headphone (for example, the headphone 400) is detected being connected to the handheld electronic device 100, the baseband circuit 170 first controls, through the control signal CS1, the operation voltage supply circuit 130 to output the operation voltage V3 and also controls, through the control signal CS1, the switch circuit 140 to output the operation voltage V3 through the second output terminal thereof. In addition, the baseband circuit 170 further controls, through the control signal CS3, the switch circuit 150 to output the voltage supplied to the first input terminal thereof and also control, through the control signal CS2, the switch circuit 160 to output the voltage supplied to the second input terminal thereof. As a result, the operation voltage V1 (derived from the operation voltage V3 of the operation voltage supply circuit 130) supplied to the first input terminal of the switch circuit 150 can be transmitted to the pin 416 of the noise-canceling headphone 400 sequentially through the switch circuit 150, the switch circuit 160 and the pin 116.

Because Vc>Vb>V1>Va, the first comparison result outputted from the voltage comparison circuit 420 has a logic-high level; and both of the second and third comparison results outputted from the voltage comparison circuits 422, 424 have logic-low levels, respectively. However, it is to be noted that meanwhile the output terminal of the voltage comparison circuit 420 is grounded through an internal circuit thereof; consequentially the voltage supplied to the control terminal of the switch circuit 432 has a logic-low level and thereby the switch circuit 432 electrically connects the first terminal thereof to the third terminal thereof. As a result, the operation voltage V1 is transmitted to the noise-canceling circuit 444. In addition, because the noise-canceling circuit 444 has specific impedance, the baseband circuit 170 can determine that the being-connected headphone 400 is a noise-canceling headphone according to the voltage at the pin 116.

To avoid the interference between the communication operation of the communication microphone and the noise-canceling operation of the noise-canceling circuit 444, in one embodiment the communication microphone and the noise-canceling circuit 444 are configured not to have function at the same time. That is, the baseband circuit 170 is further configured to either output the microphone bias voltage MIC_BIAS and thereby provide the operation power for the communication microphone if the handheld electronic device 100 decides not to activate the noise-canceling function of the noise-canceling headphone 400, or control the operation voltage supply circuit 130 to output the operation voltage V3 and thereby provide the operation power for the noise-canceling circuit 444 if the handheld electronic device 100 decides to activate the noise-canceling function of the noise-canceling headphone 400.

When the handheld electronic device 100 decides not to activate the noise-canceling function of the noise-canceling headphone 400, the baseband circuit 170 first controls, through the control signal CS1, the operation voltage supply circuit 130 to output the operation voltage V3 and also controls, through the control signal CS1, the switch circuit 140 to output the operation voltage V3 through the second output terminal thereof. In addition, the baseband circuit 170 further controls, through the control signal CS3, the switch circuit 150 to output the voltage supplied to the second input terminal thereof and also controls, through the control signal CS2, the switch circuit 160 to output the voltage supplied to the second input terminal thereof. Thus, the operation voltage V2 (derived from the operation voltage V3 of the operation voltage supply circuit 130) supplied to the second input terminal of the switch circuit 150 can be transmitted to the pin 416 of the noise-canceling headphone 400 sequentially through the switch circuit 150, the switch circuit 160 and the pin 116. In addition, because Vc>V2>Vb>Va, both of the first and second comparison results outputted from the voltage comparison circuits 420, 422, respectively, have logic-high levels; and the third comparison result outputted from the voltage comparison circuit 424 has a logic-low level. Thus, the switch circuit 430 disconnects the first terminal thereof from the second terminal and thereby has a turned-off state; and consequentially the voltage supplied to the control terminal of the switch circuit 432 has a logic-high level and thereby the switch circuit 432 electrically connects the first terminal thereof to the second terminal thereof.

Then, the baseband circuit 170 outputs the microphone bias voltage MIC_BIAS and controls, through the control signal CS1, the operation voltage supply circuit 130 to stop outputting the operation voltage V3 as well as controls, through the control signal CS1, the switch circuit 140 to output the microphone bias voltage MIC_BIAS through the first output terminal thereof. As a result, the operation voltage V4 (derived from the microphone bias voltage MIC_BIAS of the baseband circuit 170) is successfully transmitted to the pin 416 through the pin 116. In addition, because Vc>V4>Vb, both of the first and second comparison results outputted from the voltage comparison circuits 420, 422, respectively, have logic-high levels and the third comparison result outputted from the voltage comparison circuit 424 has a logic-low level. Thus, the switch circuit 430 still has a turned-off state; and consequentially the voltage supplied to the control terminal of the switch circuit 432 still has a logic-high level and thereby the switch circuit 432 still electrically connects the first terminal thereof to the second terminal thereof. Thus, the operation voltage V4 (derived from the microphone bias voltage MIC_BIAS of the baseband circuit 170) is successfully transmitted to the communication microphone of the noise-canceling headphone 400 and thereby the communication microphone is enabled to start to work. It is to be noted that the baseband circuit 170 still keeps detecting that the handheld electronic device 100 whether decides to activate the noise-canceling function of the communication microphone of the noise-canceling headphones 400 or not.

When the handheld electronic device 100 decides to activate the noise-canceling function of the noise-canceling headphones 400, the baseband circuit 170 stops outputting the microphone bias voltage MIC_BIAS and controls, through the control signal CS1, the operation voltage supply circuit 130 to output the operation voltage V3 as well as controls, through the control signal CS1, the switch circuit 140 to output the operation voltage V3 through the second output terminal thereof. In addition, the baseband circuit 170 further controls, through the control signal CS2, the switch circuit 160 to output the operation voltage V3 through the output terminal thereof. As a result, the operation voltage V3 is successfully transmitted to the pin 416 through the pin 116.

Because V3>Vc>Vb>Va, all of the first, second and third comparison results outputted from the voltage comparison circuits 420, 422 and 426, respectively, have logic-high levels. Thus, the switch circuit 430 electrically connects the first terminal thereof to the second terminal thereof and thereby has a turned-on state; and consequentially the voltage supplied to the control terminal of the switch circuit 432 has a logic-low level and thereby the switch circuit 432 electrically connects the first terminal thereof to the third terminal thereof. As a result, the operation voltage V3 is successfully transmitted to the noise-canceling circuit 444 and thereby the noise-canceling circuit 444 is enabled to start to work.

It is to be noted that the baseband circuit 170 still keeps detecting that the handheld electronic device 100 whether decides to activate the communication function of the communication microphone of the noise-canceling headphones 400 or not while the noise-canceling circuit 444 is in operation. When the handheld electronic device 100 decides to activate the communication function of the communication microphone of the noise-canceling headphones 400, the baseband circuit 170 respectively controls, through the control signals CS3 and CS2, the switch circuits 150 and 160 to transmit the operation voltage V2 to the pin 416 and thereby controls the switch circuit 432 to electrically connect the first terminal thereof to the second terminal thereof. Then, the baseband circuit 170 outputs the microphone bias voltage MIC_BIAS and controls, through the control signal CS1, the operation voltage supply circuit 130 to stop outputting the operation voltage V3 as well as controls, through the control signal CS1, the switch circuit 140 to output the microphone bias voltage MIC_BIAS through the first output terminal thereof. As a result, the operation voltage V4 (derived from the microphone bias voltage MIC_BIAS of the baseband circuit 170) is successfully transmitted to the communication microphone of the headphone 400. It is to be noted that the baseband circuit 170 still keeps detecting that the handheld electronic device 100 whether decide to stop the communication function of the communication microphone (for example, when the voice communication is over) of the noise-canceling headphones 400 or not while the communication microphone is in operation. When the handheld electronic device 100 decides to stop the communication function of the communication microphone of the noise-canceling headphones 400, the baseband circuit 170 stops outputting the microphone bias voltage MIC_BIAS and controls, through the control signal CS1, the operation voltage supply circuit 130 to output the operation voltage V3 as well as respectively controls, through the control signals CS1 and CS2, the switch circuits 140 and 160 to transmit the operation voltage V3 to the noise-canceling circuit 444.

According to the above description, it is understood that the handheld electronic device of the present invention can recognize the type of the being-connected headphone and actively provide, when the being-connected headphone is recognized as a noise-canceling headphone, the operation power for the noise-canceling circuit of the noise-canceling headphone. Thus, the noise-canceling headphone of the present invention can have normal function without equipping any battery.

Figure 4:
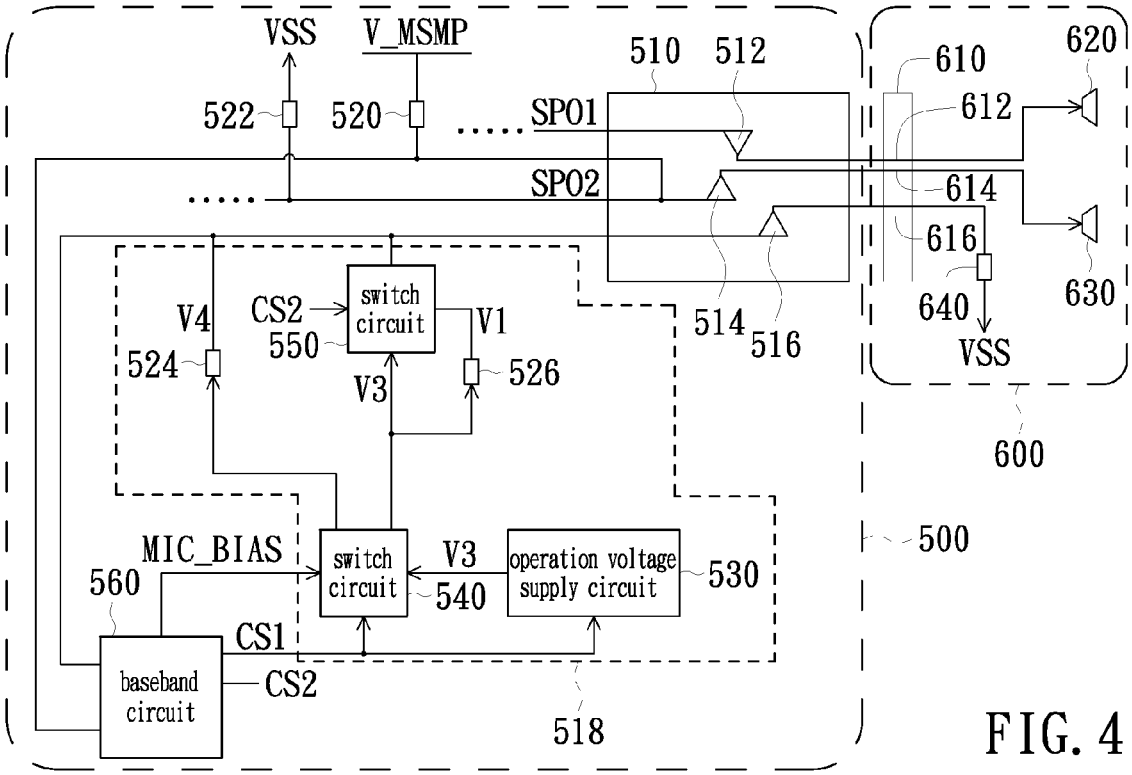
FIG. 4 is a schematic circuit diagram of a handheld electronic device and a corresponding regular headphone equipped with a communication microphone in accordance with an embodiment of the present invention.

FIG. 4 is a schematic circuit diagram of a handheld electronic device 500 and a corresponding regular headphone 600 equipped with a communication microphone in accordance with an embodiment of the present invention. As shown, the handheld electronic device 500 in this embodiment includes a connection interface 510, impedance units 520, 522, a voltage supply unit 518 and a baseband circuit 560. The connection interface 510 includes pins 512, 514 and 516. Specifically, the pin 512 is configured to transmit a speaker signal SPO1; and the pin 514 is configured to transmit a speaker signal SPO2. The impedance unit 520 is electrically connected between the pin 514 and a power supply voltage V_MSMP; and the impedance unit 522 is electrically connected between the pin 514 and a reference voltage VSS. The voltage supply unit 518 is electrically connected to the pin 516. The baseband circuit 560 is electrically connected to the pins 514, 516 and the voltage supply unit 518.

In this embodiment as shown in FIG. 4, the baseband circuit 560 is configured to determine whether there is a headphone being connected to the connection interface 510 according to a voltage change at the pin 514. If yes, the baseband circuit 560 is further configured to control the voltage supply unit 518 to provide an operation voltage V1 to the pin 516 and then determine the type of the being-connected headphone according to the voltage at the pin 516. In one case, when the being-connected headphone is determined as, for example, a noise-canceling headphone and the handheld electronic device 500 decides to activate the noise-canceling function of the noise-canceling headphone, correspondingly the baseband circuit 560 is configured to control the voltage supply unit 518 to provide an operation voltage V3 to the pin 516; wherein the operation voltage V3 herein is functioned as an operation power of a noise-canceling circuit in the noise-canceling headphone. In another case, when the being-connected headphone is determined as, for example, a noise-canceling headphone but the handheld electronic device 500 decides not to activate the noise-canceling function of the noise-canceling headphone, correspondingly the baseband circuit 560 is configured to provide a microphone bias voltage MIC_BIAS, and control the voltage supply unit 518 to convert the microphone bias voltage MIC_BIAS into an operation voltage V4 and provide the operation voltage V4 to the pin 516; wherein the operation voltage V4 herein is functioned as an operation power of the communication microphone of the regular headphone. In still another case, when the being-connected headphone is determined as, for example, a regular headphone (equipped with a communication microphone but without noise-canceling function), correspondingly the baseband circuit 560 is further configured to provide the microphone bias voltage MIC_BIAS and control the voltage supply unit 118 to convert the microphone bias voltage MIC_BIAS into the operation voltage V4 and provide the operation voltage V4 to the pin 516; wherein the operation voltage V4 herein is functioned as an operation power of the communication microphone of the regular headphone. The implementation of the voltage supply unit 518 and the operation of the baseband circuit 560 will be described in detailed as follow.

In this embodiment as shown in FIG. 4, the voltage supply unit 518 includes an operation voltage supply circuit 530, switch circuit 540, 550, and impedance units 524, 526. The operation voltage supply circuit 530 is configured to receive a control signal CS1 and determine whether to output the operation voltage V3 or not according to the received control signal CS1. The switch circuit 540 includes a first input terminal, a second input terminal, a first output terminal, a second output terminal and a control terminal. The first input terminal, the second input terminal and the control terminal of the switch circuit 540 are configured to receive the microphone bias voltage MIC_BIAS, the operation voltage V3 and the control signal CS1, respectively. The switch circuit 540 is configured to, according to the received control signal CS1, either output the microphone bias voltage MIC_BIAS through the first output terminal thereof or output the operation voltage V3 through the second output terminal thereof. The impedance unit 524, electrically connected between the first output terminal of the switch circuit 540 and the pin 516, is configured to generate the operation voltage V4. The first terminal of the impedance unit 526 is electrically connected to the second output terminal of the switch circuit 540. The switch circuit 550 includes a first input terminal, a second input terminal, an output terminal and a control terminal. The first input terminal and the second input terminal of the switch circuit 550 are electrically connected to the second output terminal of the switch circuit 540 and the second terminal of the impedance unit 526, respectively. The output terminal of the switch circuit 550 is electrically connected to the pin 516. The control terminal of the switch circuit 550 is configured to receive a control signal CS2. The switch circuit 550 is configured to, according to the received control signal CS2, either output the voltage supplied to the first input terminal thereof or output the voltage supplied to the second input terminal thereof.

In this embodiment as shown in FIG. 4, the baseband circuit 560 is further configured to provide the microphone bias voltage MIC_BIAS and the control signals CS1, CS2. In one embodiment, each one of the impedance units 520~526 may be implemented with a resistor; however the present invention is not limited thereto. In addition, it is to be noted that the impedance units 524 and 526 are configured to have different impendence values.

As shown in FIG. 4, the headphone 600 in this embodiment includes a connection interface 610, speakers 620, 630, and a communication microphone (not shown but is represented by an impedance 640). The connection interface 610 is configured to be electrically connected to the connection interface 510 of the handheld electronic device 500. The connection interface 610 includes pins 612, 614 and 616. Specifically, the pin 612 is configured to receive the speaker signal SPO1; and the pin 614 is configured to receive the speaker signal SPO2.

The baseband circuit 560 can determine whether there is a headphone being connected to the handheld electronic device 500 or not through detecting a voltage change at the pin 514. For example, when a headphone (for example, the headphone 600) is detected being connected to the handheld electronic device 500, the baseband circuit 560 first controls, through the control signal CS1, the operation voltage supply circuit 530 to output the operation voltage V3 and controls, through the control signal CS1, the switch circuit 540 to output the operation voltage V3 through the second output terminal thereof. In addition, the baseband circuit 560 further controls, through the control signal CS2, the switch circuit 550 to output the voltage supplied to the second input terminal thereof. As a result, the operation voltage V1 (derived from the operation voltage V3 of the operation voltage supply circuit 530) supplied to the second input terminal of the switch circuit 550 can be transmitted to the communication microphone of the headphone 600 sequentially through the switch circuit 550, the pin 516 and the pin 616. In addition, because the communication microphone has the specific impedance 640, the baseband circuit 560 can determine that the being-connected headphone 600 is a regular headphone equipped with a communication microphone according to the voltage at the pin 516.

Then, the baseband circuit 560 outputs the microphone bias voltage MIC_BIAS and also controls, through the control signal CS1, the operation voltage supply circuit 530 to stop outputting the operation voltage V3 as well as controls, through the control signal CS1, the switch circuit 540 to output the microphone bias voltage MIC_BIAS through the first output terminal thereof. As a result, the operation voltage V4 (derived from the microphone bias voltage MIC_BIAS of the baseband circuit 560) is successfully transmitted to the communication microphone of the headphone 600 sequentially through the pin 516 and the pin 616 and thereby the communication microphone is enabled to start to work.

Figure 5:
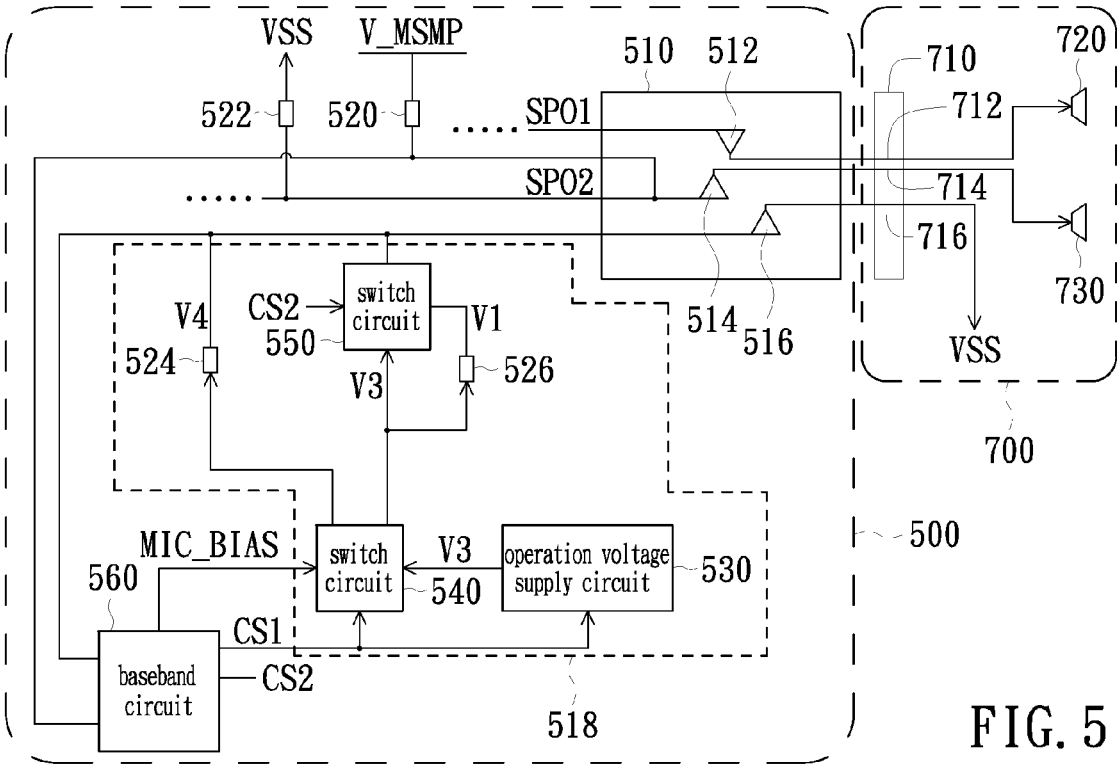
FIG. 5 is a schematic circuit diagram of a handheld electronic device and a corresponding regular headphone equipped with no communication microphone in accordance with an embodiment of the present invention.

FIG. 5 is a schematic circuit diagram of the handheld electronic device 500 and a corresponding regular headphone 700 equipped with no communication microphone in accordance with an embodiment of the present invention. The function and the circuit structure of the handheld electronic device 500 have been described above, and no redundant detail is to be given herein. As shown, the headphone 700 in this embodiment includes a connection interface 710 and speakers 720, 730. The connection interface 710 is configured to be electrically connected to the connection interface 510 of the handheld electronic device 500. The connection interface 710 includes pins 712, 714 and 716. Specifically, the pin 712 is configured to receive the speaker signal SPO1; and the pin 714 is configured to receive the speaker signal SPO2.

As described above, the baseband circuit 560 can determine whether there is a headphone being connected to the handheld electronic device 500 or not through detecting a voltage change at the pin 514. For example, when a headphone (for example, the headphone 700) is detected being connected to the handheld electronic device 500, the baseband circuit 560 first controls, through the control signal CS1, the operation voltage supply circuit 530 to output the operation voltage V3 and also controls, through the control signal CS1, the switch circuit 540 to output the operation voltage V3 through the second output terminal thereof. In addition, the baseband circuit 560 further controls, through the control signal CS2, the switch circuit 550 to output the voltage supplied to the second input terminal thereof. As a result, the operation voltage V1 (derived from the operation voltage V3 of the operation voltage supply circuit 530) supplied to the first input terminal of the switch circuit 550 can be transmitted to the headphone 700 sequentially through the switch circuit 550, the pin 516 and the pin 716. In addition, because one terminal of the pin 716 is directly electrically connected to the reference voltage VSS, the baseband circuit 560 can determine that the being-connected headphone 700 is a regular headphone equipped with no communication microphone according to the voltage at the pin 516.

Because the headphone 700 is determined as a regular headphone equipped with no communication microphone, the baseband circuit 560 is configured to not to output the microphone bias voltage MIC_BIAS. In addition, the baseband circuit 560 may be further configured to control, through the control signal CS1, the operation voltage supply circuit 530 not to output the operation voltage V3.

Figure 6:
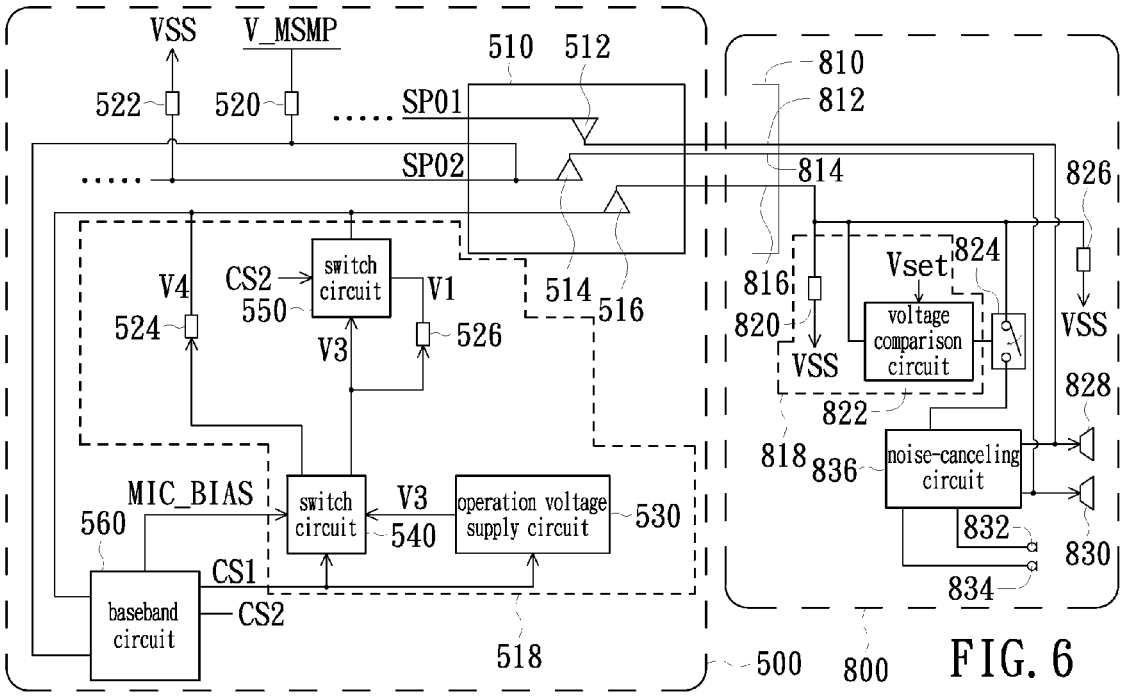
FIG. 6 is a schematic circuit diagram of a handheld electronic device and a corresponding noise-canceling headphone in accordance with an embodiment of the present invention.

FIG. 6 is a schematic circuit diagram of the handheld electronic device 500 and a corresponding noise-canceling headphone 800 in accordance with an embodiment of the present invention. The function and the circuit structure of the handheld electronic device 500 have been described above, and no redundant detail is to be given herein. As shown, the noise-canceling headphone 800 in this embodiment includes a connection interface 810, a switch circuit 824, a switch control unit 818, a communication microphone (not shown but is represented by an impedance 826), speakers 828, 830, noise-canceling microphones 832, 834, and a noise-canceling circuit 836.

The connection interface 810 is configured to be electrically connected to the connection interface 510 of the handheld electronic device 500. The connection interface 810 includes pins 812, 814 and 816. Specifically, the pin 812 is configured to receive the speaker signal SPO1; and the pin 814 is configured to receive the speaker signal SPO2. The switch circuit 824 includes a first terminal, a second terminal and a control terminal; wherein the first terminal is electrically connected to the pin 816. The switch circuit 824 is configured to determine whether to electrically connect its first terminal to its second terminal according to the voltage supplied to its control terminal. The switch control unit 818 is electrically connected to the pin 816 and the control terminal of the switch circuit 824. The switch control unit 818 is configured to control, according to the voltage at the pin 816, the switch circuit 824 to either selectively electrically connect its first terminal to its second terminal or disconnect its first terminal from its second terminal.

The switch control unit 818 includes an impedance unit 820 and a voltage comparison circuit 822. The impedance unit 820 is electrically connected between the pin 816 and the reference voltage VSS. The voltage comparison circuit 822 includes a first input terminal, a second input terminal and an output terminal. The first input terminal of the voltage comparison circuit 822 is electrically connected to the pin 816; and the second input terminal of the voltage comparison circuit 822 is configured to receive a predetermined voltage Vset. The voltage comparison circuit 822 is configured to compare the voltage at the pin 816 with the predetermined voltage Vset and accordingly output a comparison result through the output terminal thereof. In one embodiment, the impedance unit 820 may be implemented with a resistor; however the present invention is not limited thereto.

The communication microphone (not shown but is represented by an impedance 826) of the noise-canceling headphone 800 is electrically connected to the pin 816. The speaker 828 is electrically connected to the pin 812; and the speaker 830 is electrically connected to the pin 814. The noise-canceling circuit 836 is electrically connected to the second terminal of the switch circuit 824, the speakers 828, 830, and the noise-canceling microphones 832, 834.

In one embodiment, the voltage comparison circuit 822 may be implemented with a comparator, and accordingly the first and second input terminals of the voltage comparison circuit are referred to the positive and negative terminals of the comparator, respectively; but the present invention is not limited thereto. In this exemplary embodiment, it is to be noted that the aforementioned mentioned voltages are configured to have the following relationships:

$$V3>V1>V\text{set and } V\text{set}>V4$$

Furthermore, in this embodiment, the switch circuit 824 electrically connects its first terminal to its second terminal and thereby has a turned-on state when the voltage supplied to its control terminal has a logic-high level; alternatively, the switch circuit 824 disconnects its first terminal from its second terminal and thereby has a turned-off state when the voltage supplied to its control terminal has a logic-low level.

As described above, the baseband circuit 560 can determine whether there is a headphone being connected to the handheld electronic device 500 or not through detecting a voltage change at the pin 514. For example, when a headphone (for example, the headphone 800) is detected being connected to the handheld electronic device 500, the baseband circuit 560 first controls, through the control signal CS1, the operation voltage supply circuit 530 to output the operation voltage V3 and also controls, through the control signal CS1, the switch circuit 540 to output the operation voltage V3 through the second output terminal thereof. In addition, the baseband circuit 560 further controls, through the control signal CS2, the switch circuit 550 to output the voltage supplied to the second input terminal thereof. As a result, the operation voltage V1 (derived from the operation voltage V3 of the operation voltage supply circuit 530) supplied to the second input terminal of the switch circuit 550 can be transmitted to the pin 816 of the noise-canceling headphone 800 sequentially through the switch circuit 550 and the pin 516.

Because V1>Vset, the comparison result outputted from the voltage comparison circuit 822 has a logic-high level; and the switch circuit 824 electrically connects the first terminal thereof to the second terminal thereof and thereby has a turned-on state. As a result, the operation voltage V1 is transmitted to the noise-canceling circuit 836. It is to be noted that the noise-canceling circuit 836 is disabled herein due to the operation voltage V1 is smaller than the operation voltage of the noise-canceling circuit 836. In addition, because the noise-canceling circuit 836 has specific impedance and the impendence unit 820 has specific impedance, the baseband circuit 560 can determine that the being-connected headphone 800 is a noise-canceling headphone according to the voltage at the pin 516.

To avoid the interference between the communication operation of the communication microphone and the noise-canceling operation of the noise-canceling circuit 836, in one embodiment the communication microphone and the noise-canceling circuit 836 are configured not to work at the same time. That is, the baseband circuit 560 is further configured to either output the microphone bias voltage MIC_BIAS and thereby provide the operation power for the communication microphone if the handheld electronic device 500 decides not to activate the noise-canceling function of the noise-canceling headphone 800, or control the operation voltage supply circuit 530 to output the operation voltage V3 and thereby provide the operation power for the noise-canceling circuit 836 if the handheld electronic device 500 decides to activate the noise-canceling function of the noise-canceling headphone 800.

When the handheld electronic device 500 decides not to activate the noise-canceling function of the noise-canceling headphones 800, the baseband circuit 560 outputs the microphone bias voltage MIC_BIAS and controls, through the control signal CS1, the operation voltage supply circuit 530 to stop outputting the operation voltage V3 as well as controls, through the control signal CS1, the switch circuit 540 to output the microphone bias voltage MIC_BIAS through the first output terminal thereof. As a result, the operation voltage V4 (derived from the microphone bias voltage MIC_BIAS of the baseband circuit 560) is successfully transmitted to the pin 816 through the pin 516. Because Vset>V4, the comparison results outputted from the voltage comparison circuit 822 has a logic-low level. Thus, the switch circuit 824 disconnects the first terminal thereof from the second terminal thereof and thereby has a turned-off state. As a result, the operation voltage V4 (derived from the microphone bias voltage MIC_BIAS of the baseband circuit 560) is successfully transmitted to the communication microphone of the noise-canceling headphone 800 and thereby the communication microphone is enabled to start to work. It is to be noted that the baseband circuit 560 still keeps detecting that the handheld electronic device 500 whether decides to activate the noise-canceling function of the noise-canceling headphones 800 or not.

When the handheld electronic device 500 decides to activate the noise-canceling function of the noise-canceling headphone 800, the baseband circuit 560 first stops outputting the microphone bias voltage MIC_BIAS and also controls, through the control signal CS1, the operation voltage supply circuit 530 to output the operation voltage V3 as well as controls, through the control signal CS1, the switch circuit 540 to output the operation voltage V3 through the second output terminal thereof. In addition, the baseband circuit 560 further controls, through the control signal CS2, the switch circuit 550 to output the operation voltage V3 through the output terminal thereof. Thus, the operation voltage V3 supplied to the first input terminal of the switch circuit 550 can be transmitted to the pin 816 of the noise-canceling headphone 800 sequentially through the pin 516.

In addition, because V3>V1>Vset, the comparison result outputted from the voltage comparison circuit 822 has a logic-high level. Thus, the switch circuit 824 electrically connects the first terminal thereof to the second terminal thereof and thereby has a turned-on state. As a result, the operation voltage V3 is successfully transmitted to the noise-canceling circuit 836 and thereby the noise-canceling circuit 836 is enabled to start to work.

It is to be noted that the baseband circuit 560 still keeps detecting that the handheld electronic device 500 whether decides to activate the communication function of the communication microphone of the noise-canceling headphones 800 or not while the noise-canceling circuit 836 is in operation. When the handheld electronic device 500 decides to activate the communication function of the communication microphone of the noise-canceling headphones 800, the baseband circuit 560 outputs the microphone bias voltage MIC_BIAS and controls, through the control signal CS1, the operation voltage supply circuit 530 to stop outputting the operation voltage V3 as well as controls, through the control signal CS1, the switch circuit 540 to output the microphone bias voltage MIC_BIAS through the first output terminal thereof. As a result, the operation voltage V4 (derived from the microphone bias voltage MIC_BIAS of the baseband circuit 560) is successfully transmitted to the communication microphone of the headphone 800. It is to be noted that the baseband circuit 560 still keeps detecting that the handheld electronic device 500 whether decide to stop the communication function of the communication microphone (for example, when the voice communication is over) of the noise-canceling headphones 800 or not while the communication microphone is in operation. When the handheld electronic device 500 decides to stop the communication function of the communication microphone of the noise-canceling headphones 800, the baseband circuit 560 stops outputting the microphone bias voltage MIC_BIAS and controls, through the control signal CS1, the operation voltage supply circuit 530 to output the operation voltage V3 as well as respectively controls, through the control signals CS1 and CS2, the switch circuits 540 and 550 to transmit the operation voltage V3 to the noise-canceling circuit 836.

According to the above description, it is understood that the handheld electronic device of the present invention can recognize the type of the being-connected headphone and actively provide, when the being-connected headphone is recognized as a noise-canceling headphone, the operation power for the noise-canceling circuit of the noise-canceling headphone. Thus, the noise-canceling headphone of the present invention can have normal function without equipping any battery.

In summary, the handheld electronic device of the present invention includes a connection interface, a voltage supply unit and a baseband circuit. When headphones are connected to the handheld electronic device, the baseband circuit can determine the type of the headphones by controlling the operation of the voltage supply unit. Furthermore, when the headphones are noise-canceling headphones, the baseband circuit can control the operation of the voltage supply unit to provide operation power to the noise-canceling headphones. In addition, a corresponding noise-canceling headphone of the present invention includes a connection interface, at least one switch circuit, a switch control unit, a communication microphone, two speakers, a noise-canceling circuit and two noise-canceling microphones; wherein the noise-canceling headphone of the present invention can have normal function without equipping any battery.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A handheld electronic device, comprising: a connection interface, comprising a first pin, a second pin and a third pin, wherein the first pin is configured to transmit a first speaker signal and the second pin is configured to transmit a second speaker signal; a first impedance unit, electrically connected between the second pin and a power supply voltage; a second impedance unit, electrically connected between the second pin and a reference voltage; a voltage supply unit, electrically connected to the third pin; and a baseband circuit, electrically connected to the second pin, the third pin and the voltage supply unit, wherein the baseband circuit is configured to determine whether there is a headphone being electrically connected to the connection interface according to a voltage change at the second pin, wherein when there is a headphone being electrically connected to the connection interface, the baseband circuit is further configured to control the voltage supply unit to provide a first voltage to the third pin and then determine a type of the headphone according to a voltage at the third pin, wherein when the headphone is determined as a noise-canceling headphone and the handheld electronic device decides to activate a noise-canceling function of the noise-canceling headphone, correspondingly the baseband circuit is configured to control the voltage supply unit to provide a second voltage to the third pin, wherein the second voltage is functioned as an operation power of a noise-canceling circuit, for providing the noise-canceling function, of the noise-canceling headphone.

2. The handheld electronic device according to claim 1, wherein when the headphone is determined as the noise-canceling headphone and the handheld electronic device decides not to activate the noise-canceling function of the noise-canceling headphone, correspondingly the baseband circuit is configured to control the voltage supply unit to provide a third voltage to the third pin first, and then control the voltage supply unit to stop providing the third voltage but to provide a fourth voltage to the third pin, wherein the fourth voltage is functioned as an operation power of a communication microphone of the noise-canceling headphone.

3. The handheld electronic device according to claim 2, wherein when the headphone is determined as a regular headphone equipped with a communication microphone but without the noise-canceling function, correspondingly the baseband circuit is configured to provide a microphone bias voltage and control the voltage supply unit to convert the microphone bias voltage into the fourth voltage and provide the fourth voltage to the third pin, wherein the fourth voltage is functioned as an operation power of the communication microphone of the regular headphone.

4. The handheld electronic device according to claim 3, wherein the voltage supply unit comprises: an operation voltage supply circuit, configured to receive a first control signal and determine whether to output an operation voltage or not according to the first control signal; a first switch circuit, comprising a first input terminal, a second input terminal, a first output terminal, a second output terminal and a first control terminal, wherein the first input terminal, the second input terminal and the first control terminal are configured to receive the microphone bias voltage, the operation voltage and the first control signal, respectively, wherein the first switch circuit is configured to, according to the first control signal, either output the microphone bias voltage through the first output terminal or output the operation voltage through the second output terminal; a third impedance unit, electrically connected between the first output terminal and the third pin, wherein the third impedance unit is configured to generate the fourth voltage; a fourth impedance unit, wherein a first terminal of the fourth impedance unit is electrically connected to the second output terminal; a fifth impedance unit, wherein a first terminal of the fifth impedance unit is electrically connected to the second output terminal; a second switch circuit, comprising a third input terminal, a fourth input terminal, a third output terminal and a second control terminal, wherein the third input terminal and the fourth input terminal are electrically connected to a second terminal of the fourth impedance unit and a second terminal of the fifth impedance unit, respectively, the second control terminal is configured to receive a second control signal, wherein the second switch circuit is configured to, according to the second control signal, either output a voltage supplied to the third input terminal for being as the first voltage or output a voltage supplied to the fourth input terminal for being as the third voltage; and a third switch circuit, comprising a fifth input terminal, a sixth input terminal, a fourth output terminal and a third control terminal, wherein the fifth input terminal and the sixth input terminal are electrically connected to the second output terminal and the third output terminal, respectively, the fourth output terminal is electrically connected to the third pin, the third control terminal is configured to receive a third control signal, wherein the third switch circuit is configured to, according to the third control signal, either output a voltage supplied to the fifth input terminal for being as the second voltage or output a voltage supplied to the sixth input terminal, wherein the baseband circuit is further configured to provide the microphone bias voltage, the first control signal, the second control signal and the third control signal.

5. The handheld electronic device according to claim 4, wherein each one of the first, second, third, fourth and fifth impedance units is implemented with a resistor.

6. The handheld electronic device according to claim 1, wherein when the headphone is determined as the noise-canceling headphone and the handheld electronic device decide not to activate the noise-canceling function of the noise-canceling headphone, correspondingly the baseband circuit is configured to provide a microphone bias voltage and control the voltage supply unit to convert the microphone bias voltage into a third voltage and provide the third voltage to the third pin, wherein the third voltage is functioned as an operation power of a communication microphone of the noise-canceling headphone.

7. The handheld electronic device according to claim 6, wherein when the headphone is determined as a regular headphone equipped with a communication microphone but without the noise-canceling function, correspondingly the baseband circuit is configured to provide the microphone bias voltage and control the voltage supply unit to convert the microphone bias voltage into the third voltage and provide the third voltage to the third pin, wherein the third voltage is functioned as an operation power of the communication microphone of the regular headphone.

8. The handheld electronic device according to claim 7, wherein the voltage supply unit comprises: an operation voltage supply circuit, configured to receive a first control signal and determine whether to output an operation voltage or not according to the first control signal; a first switch circuit, comprising a first input terminal, a second input terminal, a first output terminal, a second output terminal and a first control terminal, wherein the first input terminal, the second input terminal and the first control terminal are configured to receive the microphone bias voltage, the operation voltage and the first control signal, respectively, wherein the first switch circuit is configured to, according to the first control signal, either output the microphone bias voltage through the first output terminal or output the operation voltage through the second output terminal; a third impedance unit, electrically connected between the first output terminal and the third pin, wherein the third impedance unit is configured to generate the third voltage; a fourth impedance unit, wherein a first terminal of the fourth impedance unit is electrically connected to the second output terminal; and a second switch circuit, comprising a third input terminal, a fourth input terminal, a third output terminal and a second control terminal, wherein the third input terminal and the fourth input terminal are electrically connected to the second output terminal and a second terminal of the fourth impedance unit, respectively, the third output terminal is electrically connected to the third pin, the second control terminal is configured to receive a second control signal, wherein the second switch circuit is configured to, according to the second control signal, either output a voltage supplied to the third input terminal for being as the second voltage or output a voltage supplied to the fourth input terminal for being as the first voltage, wherein the baseband circuit is electrically connected to the second pin and the third pin and is further configured to provide the microphone bias voltage, the first control signal and the second control signal.

9. The handheld electronic device according to claim 8, wherein each one of the first, second, third and fourth impedance units is implemented with a resistor.

* * * * *